United States Patent [19]

Forster

[11] 4,198,899

[45] Apr. 22, 1980

[54] AXIAL-PISTON MACHINE OF VARIABLE OUTPUT HAVING A SLIDE FOR DISPLAYING THE CYLINDER DRUM

[75] Inventor: Franz Forster, Mühlbach, Fed. Rep. of Germany

[73] Assignee: Linde AG, Wiesbaden, Fed. Rep. of Germany

[21] Appl. No.: 836,848

[22] Filed: Sep. 26, 1977

[30] Foreign Application Priority Data

Sep. 24, 1976 [DE] Fed. Rep. of Germany ..... 2642900

[51] Int. Cl.[2] ..... F01B 13/04

[52] U.S. Cl. ..... 91/505

[58] Field of Search ..... 91/504–506, 91/491

[56] References Cited

U.S. PATENT DOCUMENTS 3,078,808 2/1963 Byers, Jr. ..... 91/491

3,096,723 7/1963 Puryear ..... 91/485

3,915,069 10/1975 Wagenseil ..... 91/504

FOREIGN PATENT DOCUMENTS 1453839 10/1976 United Kingdom ..... 91/491

*Primary Examiner*—William L. Freeh

*Attorney, Agent, or Firm*—Karl F. Ross

[57] ABSTRACT

An axial-piston machine such as an axial-piston motor or, preferably, an axial-piston pump, has a cylinder drum rotatable in a chamber defined by the machine housing, the cylinder bores at low pressure communicating with the interior of the housing. Only part of the end of the cylinder drum turned toward a displacing slide covers the surface of this slide which is provided with an arcuate groove for communication with the cylinder bores under elevated pressure while the control surface of this slide only covers the high-pressure portion of the surface of the cylinder drum so that the latter overhangs the slide.

3 Claims, 6 Drawing Figures

AXIAL-PISTON MACHINE OF VARIABLE OUTPUT HAVING A SLIDE FOR DISPLAYING THE CYLINDER DRUM

FIELF OF THE INVENTION

The present invention relates to an axial-piston machine and, more particularly, to an axial-piston machine which can operate as a motor but preferably is a pump having a slide for displacing the cylinder and adjusting the output of the machine.

BACKGROUND OF THE INVENTION

An axial-piston pump generally comprises a cylinder drum provided with a plurality of angularly equispaced cylinder bores (hereinafter cylinders) in which respective pistons are reciprocatable. The pistons bear upon an inclined disk or swash plate or a drive flange, depending upon the type of axial-piston machine and, when the plane of this member lies at an angle to the axis of the drum, the machine can operate either as a pump or as a motor. In the first case, the cylinder drum is rotated so that the pistons reciprocate within the cylinders and alternately draw fluid into the cylinder bores and express fluid therefrom.

When the machine operates as a motor, fluid is forced under pressure into the cylinder bores, causing the cylinder drum to rotate and thereby drive a shaft which is connected indirectly or directly to the cylinder drum.

As previously noted, axial-piston machines are available with inclined disks or swash plates or with drive flanges, i.e. systems in which the pistons react against but slide relative to an inclined surface and systems in which the piston hands entrained in rotation by the drum or which entrain the drum in rotation, depending upon whether the machine is operated as a motor or a pump, rotate with inclined surface.

To adjust the output of the machine, i.e. the volume of displaced fluid per revolution of the pump or the torque and speed of a motor, means can be provided for adjusting the angle included between the axis of the drum and the reaction surface for the pistons.

In drive-flange type axial-piston machines, the stroke volume per revolution is adjusted generally by one of two systems. In the first system, hereinafter denominated the pivotal-housing configuration, the cylinder drum is rotatable in the nonrotatable but swingable housing which can be tilted about an axis perpendicular to the axis of rotation of the drum to vary the inclination of its axis to the reaction surface. In the other system, hereinafter referred to as the swingable slide configuration, the cylinder drum within a fixed housing bears against a slide which is swingable to carry the drum into different positions and allow the inclination of its axis relative to the reaction surface to be adjusted. The swingable slide normally is guided along a curved guide surface in the fixed housing and has a complementary curvature. The invention is concerned primarily with an axial-piston machine of this latter type.

In swingable-slide, drive-flange axial-piston machines, the end of the cylinder drum toward the slide rotates upon a slide surface, in prior-art systems, which completely covers the end of the drum and hence has a cross section which is at least equal to that of the drum at the end thereof opposite that from which the pistons emerge. This surface of the control slide is usually provided with a pair of arcuate grooves (kidney-shaped grooves) separated from each other by webs and successively registering with the cylinder bores of the drum. One of these grooves communicates with the low-pressure side of the hydraulic system while the other groove communicates with the high-pressure side thereof.

To permit such communication, the side of the slide turned toward the housing is provided with two openings each communicating within the slide with a respective one of the arcuate grooves. A pair of passages are formed in the guide surface of the housing or otherwise therein for communication with the two openings of the slide. Each of these passages thus communicates with respective one of the openings and hence with a respective one of the arcuate grooves. These passages are generally elongated to permit the openings to communicate with them in all positions of the slide so that only a portion of each of the passages or channels communicates with an opening at any time while the slide covers the remainder of each channel. The two channels are connected via respective bores to the intake and discharge ports for the hydraulic medium.

An axial-piston pump of this general type is already known in which the suction side of the device communicates with the interior of the housing. In this case, the suction opening in the swingable slide communicates with a channel in the housing which is longer than the slide so that in all positions of the latter at least an end of the channel is no longer covered thereby and this end of the channel can communicate directly with the housing chamber surrounding the drum.

This system has been found to have the advantage that the intake of the pump includes the housing chamber and hence the hydraulic medium lubricates all of the moving parts while minimizing constrictions at the intake side and affording a cooling of the unit.

In addition, the arrangement has been found to reduce the noise output of the machine and to permit leakage oil to pass directly into the housing chamber and hence be returned to the pump cycle. Reference may be had, in this connection, to German Utility Model DT-Gbm No. 74 00 915.

German Printed Application DT-AS No. 1 653 417 describes a swash-plate machine, i.e. a machine in which the axis of the cylinder drum is fixed and the reaction surface for the pistons is tilted, in which there is provided between the housing and the cylinder drum a thin planar control disk which is provided with arcuate grooves for communication with the cylinders. At the suction side, this disk is interrupted along its outer periphery to permit communication between the intake side of the device and the housing.

However, this interruption of the control disk constitutes a disadvantageous weakening thereof which detrimentally affects the running of the pump. This arrangment has been found to be completely impractical for applications to drive-flange machines having swingable-slide configurations.

The system described in the aforementioned Utility Model also has been found to be unsatisfactory although it indeed eliminates the need for an additional passage or channel communicating between the intake groove and the interior of the housing.

In this arrangement, the flow resistance created by the prolonged channel and the arcuate groove which communicates therewith and with the cylinder drum has a high flow resistance which defeats, in large measure, the advantages of drawing fluid from the machine housing.

OBJECTS OF THE INVENTION

It is the principal object of the present invention to provide an axial-piston machine, particularly of the drive-flange, swingable-slide, variable-output type whereby the aforementioned disadvantages are obviated and the advantages of a low-pressure-drum communication between the drum and the housing chamber surrounding the drum can be attained in a simple, economical and convenient manner without interfering with the running of the pump or motor.

It is another object of this invention to provide a hydraulic pump of the axial-piston type which permits a direct flow from the interior of the housing to the cylinder drum when the machine is operated as a pump and a direct discharge from the cylinder drum into the housing inner chamber when the machine is operated as a motor.

SUMMARY OF THE INVENTION

These objects are attained, in accordance with the present invention, by providing a drive-flange swingable-slide axial-piston pump in which the slide is relatively smaller than the outline of the end of the drum bearing thereagainst and extends substantially only over half of the surface at the end of the drum. Consequently, the surface of the slide which is turned toward the drum covers only the high-pressure bores of the drum as the latter rotates against this slide and hence encompasses only the high-pressure arcuate groove and a region surrounding the axis of the drum within the circle of ports communicating with the cylinders of the drum at the end thereof opposite that at which the pistons project therefrom. The slide thus covers only the high-pressure ports of the cylinder bores while the remaining surface of the drum is free and the ports at these surfaces communicates freely with the inner chamber of the housing. The slide is thus not supported at this region of free communication with the interior of the housing.

In contrast with the prior-art constructions, the new arrangement of the present invention has the advantage that the discharge from the cylinder drum is effected from an overhanging portion of the drum without having to pass through any arcuate grooves or other passages or channels into the housing interior. Surprisingly, the fact that the drum in part overhangs the slide does not introduce any problems with respect to the running of the drum or the retention of the drum under pressure against the slide and the slide against its guide track in the housing. The cylinder drum is held against the slide and the slide is held against the guide track at least in part by surface overhang of the cylinder bores with respect to the openings or ports in the cylinder drum end engageable with the slide. The control level surface should be planar in accordance with the principles of the present invention. When the pressing force is only or at least in major part a result of the aforementioned surface overhang or is generated by any conventional means, for example, auxiliary pistons, the pressing force is generated primarily by each pressurized cylinder and is concentrated in the region in which the cylinder drum lies against the swingable slide. In addition, a central pressing force can be provided on a central pin to ensure effective bracing of the drum against the slide.

The system also has been found to assure the formation of a lubricating film between the cylinder drum and the control level surface.

Where the cylinder overhangs the slide, the cylinder bores communicates directly with the interior of the housing so that an unobstructed flow with minimum pressure losses of the hydraulic medium from the low-pressure cylinders into the housing chamber is attained. Hence the pressure at the cylinder discharge ports and in the housing interior is substantially equal.

Moreover, when fluid flow from the housing chamber into the cylinders is desired, i.e. in the case of a pump, optimum results are achieved because cavitation and like impediments are likely to occur at high speeds of the drum than has been found to result when the intake is through channels in the housing.

The inflow efficiency can be further improved when the wall of the housing opposite the overhanging portion of the cylinder drum is set back so that a relatively large space is provided between the force communicating with the cylinder and the opposite housing walls. A similar or additional improvement can be gained when these housing walls are shaped to guide the fluid toward the ports of the overhanging portion of the cylinder.

The guide track along which the slide is displaceable in the housing or housing bottom can be cylindrical with an axis of curvature coaxial with the pivot axis for the cylinder drum. This surface can, however, also be spherical so that its center of curvature lies at the intersection of the tilting axis of the drum and the rotation axis of the drum. This center can, however, be offset from the rotation axis of the drum.

The guide surface on the housing can also be toroidal with the center of curvature of the larger radius lying along the tilting axis of the cylinder drum and the center of curvature of the smaller radius lying in a plane which is offset to the side of the rotation axis of the drum along which the slide is primarily disposed.

When the control level surface between the cylinder drum and the slide is planar especially effective results have been found with respect to the displacement of the slide along its guide track.

According to another feature of the invention, one of the surfaces of the slide and the housing along the track is formed with a groove while a projection reaches from the other surface into this groove and forms a key parallel to the direction of displacement of the slide. In addition or alternatively, the slide and the housing may have mutually engaging surfaces perpendicular to the swing axis of the drum along which the slide is guided.

The slide may be displaced by a pin which itself is shiftable parallel to the direction of displacement of the slide, preferably linearly. The key can be provided between the housing channel and the opening in the slide communicating therewith.

The system of the present invention provides significantly increased flow for an axial-piston pump and hence improves the efficiency of the axial-piston machine. Leakage oil which enters the housing chamber is entrained in the pumping cycle. When the hydraulic line which feeds fluid to the housing chamber enters the latter at the highest point of this chamber, the venting means which has hitherto been conventional in hydraulic machines of this type can be completely eliminated since it appears that air solubilized in the fluid is continuously entrained with the suction stream by the cylinder drum.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
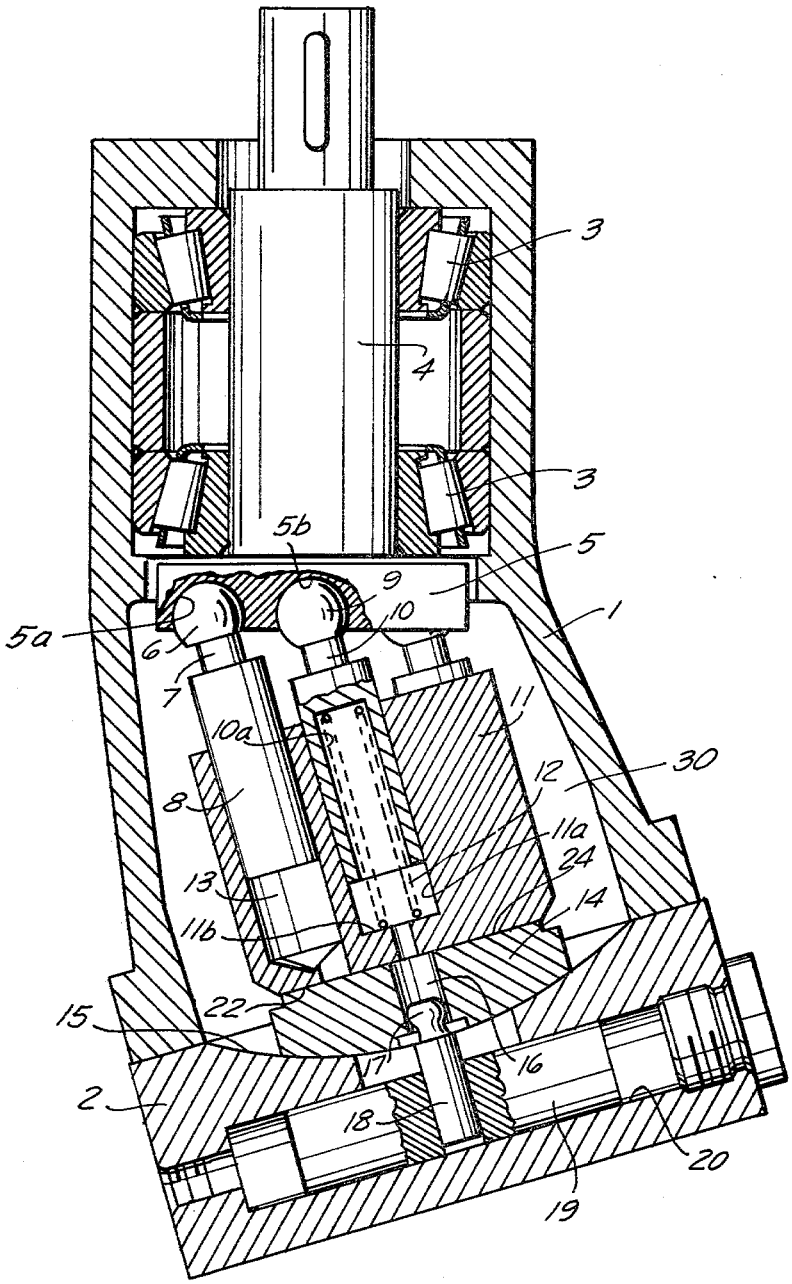
FIG. 1 is a diagrammatic axial cross-sectional view showing the relationship of the drive shaft, cylinder drum and slide in an axial-piston machine according to the invention.

The housing 1 is covered by a housing cover or bottom 2. The housing 1 is provided with two roller bearings 3 which rotatably journal the drive shaft 4, the latter being connected rigidly with the drive flange 5.

The drive flange 5 is formed with a plurality of angularly equispaced spheroidal sockets 5*a* in which respective spheroidal heads 6 of piston rods 7 are journaled. Each of the piston rods 7 is connected with a piston 8. At the center of the drive flange 5, there is provided a further spheroidal socket 5*b* in which a ball head 9 of a central pin 10 is received.

The central pin 10 extends in a central bore 11*a* of a cylinder drum 11 and is provided with a concavity 10*a* in which a spring 12 is received. The spring 12 bears against a wall 11*b* of the bore 11*a* and thus serves to press the cylinder drum 11 against a slide 14 described in greater detail hereinafter. The pin 10 ensures rotation of the drum 11 about its axis which, depending upon the position of the slide 14, can be more or less inclined to the plane of the reaction surface for the pistons formed by the drive flange 5.

The cylinder drum 11 is formed with a plurality of angularly equispaced cylinder bores (hereinafter cylinders) 13 which lie parallel to the axis of the drum and each reciprocatably receive a piston 8.

The cylinder drum 11 lies with only part of its end face 22 against the swingable slide 14, the slide resting, in turn, against a guide surface 15 forming a guide track in the housing bottom 2. The mutually engaging surfaces of the slide 14 and the track 15 have a center of curvature at the intersection between the axis of shaft 4 and the axis of drum 11, hence at the center of the head 9.

The slide 14 is provided with a bore 16 in which the head 17 of an adjusting pin 18 engages. The adjusting pin 18 is, in turn, lodged in a setting piston 19 which is displaceable in a setting cylinder 20 which can be pressurized selectively with hydraulic fluid, e.g. by a servomechanism of the type commonly used for control of such axial-piston machines.

Figure 2:
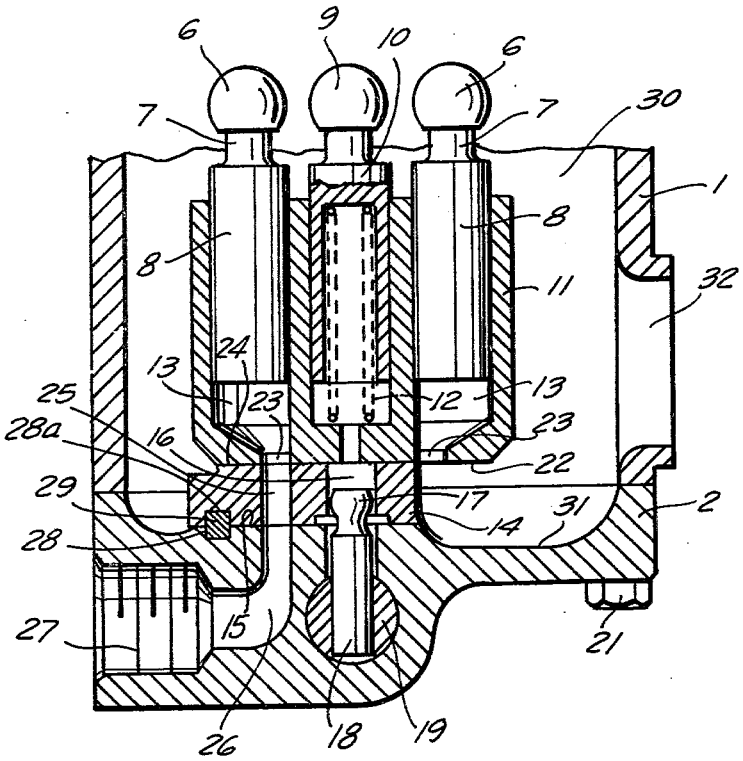
FIG. 2 is a section taken along the axis of rotation of the cylinder drum perpendicular to the sectional plane of FIG. 1 and omitting portions of the drive shaft and related structure which are not significant for an explanation of the present invention.
Figure 3:
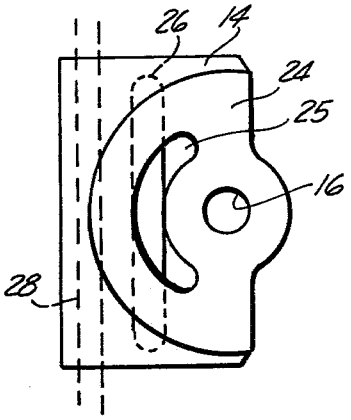
FIG. 3 is a plan view of the swingable slide.

The housing bottom 2 is releasably connected to the remainder of the housing 1 by screws 21 (see FIG. 2).

Each cylinder 13 in the cylinder drum is formed, at the end face 22 thereof, with a port 23 whose width in the radial direction and in the circumferential direction defines the radius and diameter of the control level surface or contact face which is engaged by the cylinder drum. The surface area determines the highest friction speed at the outer perimeter of this contact area.

The end face 22 of the cylinder drum 11 bears upon the control level surface 24 formed by the slide 14, this control level surface being provided with a control pressure groove 25 which is arcuate and which successively registers with the ports 23 of the cylinders 13. The arcuate groove 25 is connected with a channel 26 formed in the housing bottom 2 and communicating, in turn, with a fitting 27 for the pressure line.

In the guide track 15, there is provided a groove 28 in which a key 29 fixed in a groove of the slide 14 is engaged. The key 29 and the grooves 28 and 28*a* prevent lateral displacement of the slide 14. Instead of the key 29, two keys can be used in the form of pins or one of the surfaces which engage along the track may be provided with a projection reaching into a groove formed in the other surface.

The cylinders 13 whose ports 23 successively communicate with the groove 25 are thus in turn connected with the channel 26 and deliver the fluid medium under pressure thereto when the machine is operated as a pump.

The slide 14 is of a width which is smaller than the diameter of the end face 22 so that the side of the drum opposite that along which the groove 25 is provided overhangs the slide 14 (see FIG. 2) and permits hydraulic fluid discharge from the ports 23 when the cylinders reach this side, freely into the inner chamber 30 of the housing 1.

The inner wall 31 of the housing bottom 2 is, in the region at which the ports 23 discharge into the space 30, set downwardly or back from the drum 11 so that the liquid enters a large free cross section in an unimpeded manner. On the side wall of the housing 1, there is provided an opening or fitting 32 which can be connected to a low-pressure line or to reservoir compartment.

When the entire machine is to be introduced into a supply vessel or reservoir, this opening 32 can merely communicate with the remainder of the reservoir.

Figure 4:
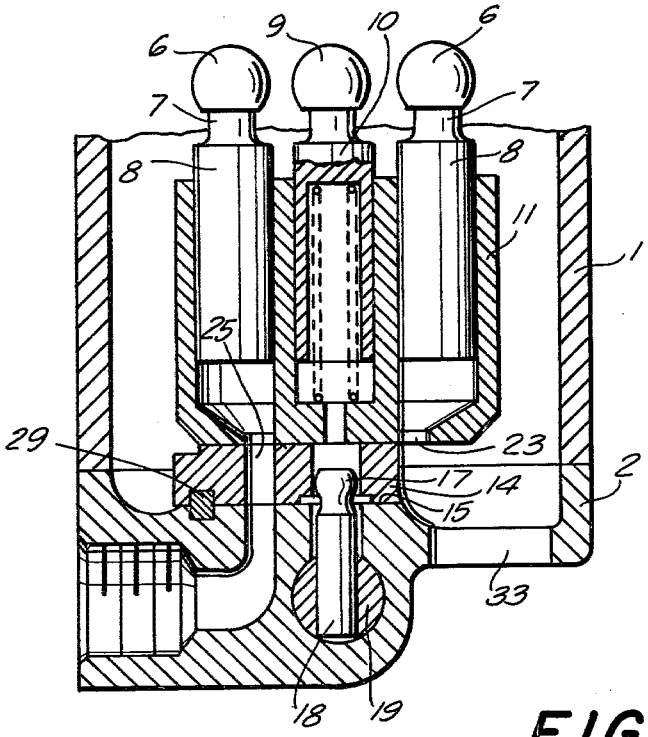
FIG. 4 shows another embodiment in section corresponding to FIG. 2 but differing therefrom in the arrangement of the opening for feeding the fluid under pressure.

The embodiment illustrated in FIG. 4 differs from that of FIG. 2 in that no opening 32 is provided in the lateral wall of the housing 1. In this case, an opening 33 is formed in the housing bottom 2. This construction has been found to be especially effective when the machine is to be operated as an axial-piston motor.

Figure 5:
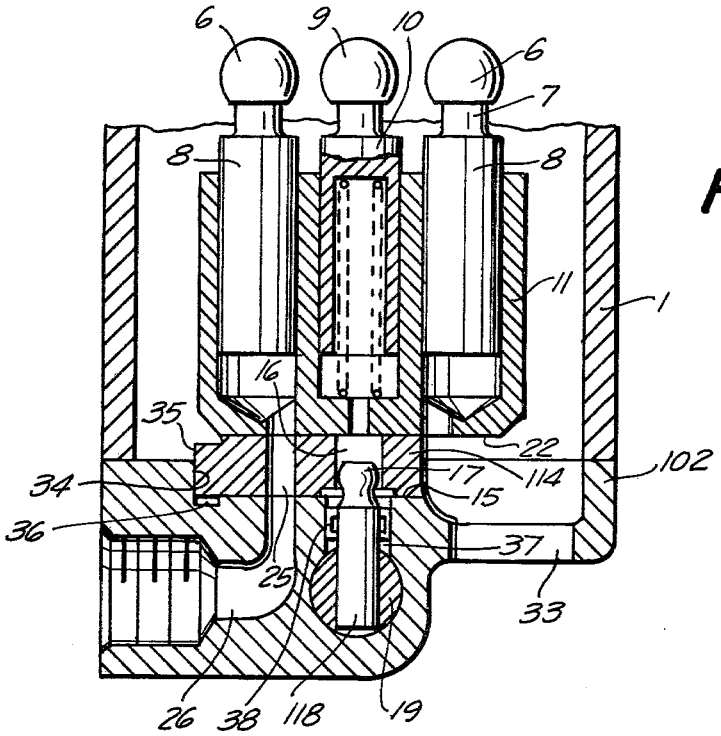
FIG. 5 shows another section corresponding to the section of FIG. 2 but illustrating still another embodiment of the invention.
Figure 6:
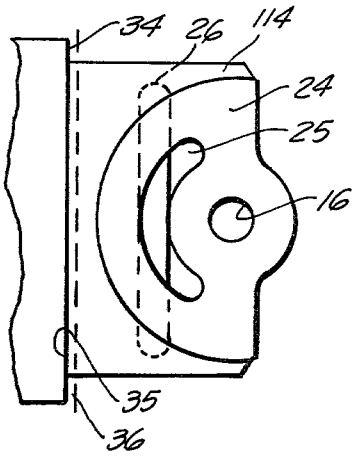
FIG. 6 is a plan view of the swingable slide of the axial-piston machine of FIG. 5.

In the embodiment illustrated in FIGS. 5 and 6, the lateral guide means of the slide 114 differs in that the groove 28 and the key 29 are not used. Here, however, the slide 14 is completely smooth on its side engaging the track 15. However, the housing bottom 102 is here provided with a guide surface 34 which lies substantially perpendicular to the surface of the guide track 15 and engages a countersurface 35 of the slide 114. A groove 36 at the junction of the surface 34 with the track 15 has been found to be advantageous to facilitate fabrication. Friction between the end face 22 of the cylinder drum 11 and the control level surface 24 on the slide 114 tends to impart a torque to the slide 114 which is taken up by the lateral guide means described.

To ensure a flush contact between the surfaces 34 and 35, the setting pin 118 is guided in a bore 37 of the housing bottom 102 by a ring 38 with precision so that the pin 118 with its ball head 17 engages the inner wall of the bores 16 and delivers to the slide 114 force which ensures firm and complete contact of the slide surface 35 with the guide surface 34.

I claim:

1. An axial-piston machine comprising a housing, a cylinder drum rotatable in said housing about an axis, a plurality of pistons reciprocatable in respective cylinders formed in said drum, means defining a reaction surface engageable by said pistons, each of said cylinders being formed on an end face of said drum with a respective port, an arcuately displaceable slide on said housing engaging said end face and entraining said cylinder drum to swing said axis, said slide being formed with an arcuate groove successively communicating with said ports, said slide covering only a portion of said end face whereby another portion corresponding to the cylinders at low pressure overhangs said slide whereby the ports of the cylinders at low pressure discharge freely into the interior of said housing, and means for displacing said slide, said housing being formed with an arcuate track having an arcuate surface juxtaposed with and slidably engaging an arcuate surface of said slide, said arcuate surface of said track being formed with a passage communicating with said groove, one of said arcuate surfaces is formed in a further groove and the other of said arcuate surfaces is formed with a projection engaging in said further groove for laterally guiding said slide.

2. The machine defined in claim 1 wherein the groove and projection for laterally guiding said slide are disposed between the groove communicating with said port and the outer edge of said slide.

3. An axial-piston machine comprising a housing, a cylinder drum rotatable in said housing about an axis, a plurality of pistons reciprocatable in respective cylinders formed in said drum, means defining a reaction surface engageable by said pistons, each of said cylinders being formed on an end face of said drum with a respective port, an arcuately displaceable slide on said housing engaging said end face and entraining said cylinder drum to swing said axis, said slide being formed with an arcuate groove successively communicating with said ports, said slide covering only a portion of said end face whereby another portion corresponding to the cylinders at low pressure overhangs said slide whereby the ports of the cylinders at low pressure discharge freely into the interior of said housing, means for displacing said slide, said housing being formed with an arcuate track having an arcuate surface justaposed with and slidably engaging an arcuate surface of said slide, said arcuate surface of said track being formed with a passage communicating with said groove, and means including a pin engaging said slide for simultaneously displacing same and laterally guiding said slide.

* * * * *